US007521166B2

(12) United States Patent
Sata et al.

(10) Patent No.: US 7,521,166 B2
(45) Date of Patent: Apr. 21, 2009

(54) PROCESS FOR PREPARING TONER FOR ELECTROPHOTOGRAPHY

(75) Inventors: Shinichi Sata, Wakayama (JP); Yoshinobu Ishikawa, Wakayama (JP); Nobumichi Kamiyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 476 days.

(21) Appl. No.: 11/266,329

(22) Filed: Nov. 4, 2005

(65) Prior Publication Data

US 2006/0105262 A1 May 18, 2006

(30) Foreign Application Priority Data

Nov. 16, 2004 (JP) ..... 2004-332135
Nov. 18, 2004 (JP) ..... 2004-335011

(51) Int. Cl.
*G03G 9/087* (2006.01)

(52) U.S. Cl. ..... 430/137.14; 430/109.4

(58) Field of Classification Search ..... 430/109.4, 430/137.14, 137.19
See application file for complete search history.

(56) References Cited

U.S. PATENT DOCUMENTS 5,591,556 A * 1/1997 Shimomura et al. ..... 430/110.1
5,843,614 A 12/1998 Shinzo et al.
6,130,021 A 10/2000 Patel et al.
6,346,358 B1 * 2/2002 Cheng ..... 430/137.14
2003/0027066 A1 2/2003 Yamashita et al.
2003/0190543 A1 10/2003 Sugiura et al.
2005/0271965 A1 * 12/2005 Kamiyoshi et al. ..... 430/111.4

FOREIGN PATENT DOCUMENTS

CN 1456942 A 11/2003

OTHER PUBLICATIONS

Patent Abstracts of Japan, JP 2004-198598A, Jul. 15, 2004.
Patent Abstracts of Japan, JP 9-311502A, Dec. 2, 1997 (corr. US 5,843,614).
Patent Abstracts of Japan, JP 2002-296839A, Oct. 9, 2002 (corr. US 2003/0027066 A1).
Patent Abstracts of Japan, JP 7-333890A, Dec. 22, 1995.
U.S. Appl. No. 11/851,795, filed Sep. 7, 2007, Kamiyoshi et al.

* cited by examiner

*Primary Examiner*—Janis L Dote
(74) *Attorney, Agent, or Firm*—Oblon, Spivak, McClelland, Maier & Neustadt, P.C.

(57) ABSTRACT

A process for preparing a toner for electrophotography comprising a resin binder and a colorant, including the steps of (1) forming primary particles containing the resin binder and the colorant in an aqueous medium in the presence of a nonionic surfactant; and (2) aggregating the primary particles, and unifying the aggregated particle; and a toner for electrophotography obtainable by the process defined above, containing a crystalline polyester in an amount of 60% by weight or more in the toner, wherein the toner has a volume-median particle size ($D_{50}$) of from 1 to 7 μm. The toner for electrophotography obtained by the present invention can be suitably used in, for example, development of a latent image formed in electrophotography, electrostatic recording method, electrostatic printing method, or the like.

16 Claims, No Drawings

PROCESS FOR PREPARING TONER FOR ELECTROPHOTOGRAPHY

FIELD OF THE INVENTION

The present invention relates to a toner for electrophotography used for, for example, developing an electrostatic latent image formed in electrophotography, electrostatic recording method, electrostatic printing method, or the like, and a process for preparing the toner.

BACKGROUND OF THE INVENTION

In recent years toners have been desired to have smaller particle sizes from the viewpoint of achieving even higher image qualities. Processes for preparing toners include a melt-kneading and pulverization method, and a wet process such as an emulsification and aggregation method. When a toner containing a resin binder containing a crystalline polyester as a main component is prepared by the melt-kneading and pulverization method, it is difficult to control the pulverization, thereby making it impractical.

JP2004-198598 A and JP-A-Hei-9-311502 each discloses an invention relating to the preparation of a toner by an emulsification and aggregation method, which is a wet process. However, in the process described in JP2004-198598 A, an applicable resin binder is limited to one that is soluble in an organic solvent, and in the case of a resin having low solubility in an organic solvent, the yield of toner is dramatically lowered. In addition, in the process described in JP-A-Hei-9-311502, although an aqueous medium is used in place of an organic solvent, fine particles are formed by a mechanical means, a specialized disperser is necessitated to obtain a mechanical force for forming particles having smaller sizes.

In addition, JP2002-296839 A and JP-A-Hei-7-333890 each discloses an invention using a masterbatch of a colorant in a wet process. However, in the process described in JP2002-296839 A, an applicable resin binder is limited to one that is soluble in an organic solvent, and in the case of a resin binder having low solubility in an organic solvent, the yield of toner is undesirably dramatically lowered. In addition, even in the solvent suspension method described in JP-A-Hei-7-333890, not only a resin binder is limited to one that is soluble in an organic solvent, but also a particle size of a droplet which can be prepared by a suspension method is limited, so that the toner is limited in controlling its particle size and particle size distribution.

SUMMARY OF THE INVENTION

The present invention relates to:

[1] a process for preparing a toner for electrophotography, containing a resin binder and a colorant, including the steps of:

(1) forming primary particles containing the resin binder and the colorant in an aqueous medium in the presence of a nonionic surfactant; and (2) aggregating primary particles, and unifying the aggregated particles; and

[2] a toner for electrophotography obtainable by the process as defined in the above [1], containing 60% by weight or more of a crystalline polyester, wherein the toner has a volume-median particle size ($D_{50}$) of from 1 to 7 μm.

DETAILED DESCRIPTION OF THE INVENTION

The present invention relates to a process capable of easily preparing a toner for electrophotography having a small particle size in a high yield without being limited to the kind of a resin binder, and a toner for electrophotography obtained by the process.

According to the present invention, a toner for electrophotography having a small particle size can be easily prepared in a high yield without being limited to the kind of a resin binder. Further, according to the process of the present invention, since the toner can be prepared without an organic solvent, the process is also useful from the viewpoint of environmental friendliness and conservation of energy.

These and other advantages of the present invention will be apparent from the following description.

The toner for electrophotography obtained by the present invention contains at least a resin binder and a colorant.

The resin binder in the present invention includes a known resin usable in a toner, for example, polyesters, styrene-acrylic resins, epoxy resins, polycarbonates, polyurethanes, and the like. Among them, the polyester and the styrene-acrylic resin are preferable. From the viewpoint of dispersibility of the colorant, fixing ability, and durability, the polyester is more preferable. The polyester is contained in an amount of preferably 60% by weight or more, more preferably 70% by weight or more, and even more preferably 80% by weight or more, of the resin binder.

The polyester may be any of crystalline polyesters and amorphous polyesters. From the viewpoint of low-temperature fixing ability, it is more preferable that the polyester contains a crystalline polyester.

The extent of the crystallinity of the polyester is expressed in index of crystallinity as defined by a ratio of the softening point to the highest temperature of endothermic peak determined by a differential scanning calorimeter, i.e., (softening point)/(highest temperature of endothermic peak). Generally, when the value for the index of crystallinity exceeds 1.5, the resin is amorphous; and when the value is less than 0.6, the crystallinity is low and much of the portions are amorphous. The extent of the crystallinity can be adjusted by the kinds of the raw material monomers and a ratio thereof, preparation conditions (for example, reaction temperature, reaction time, and cooling rate), and the like. The highest temperature of endothermic peak refers to the temperature of an endothermic peak on the highest temperature among the endothermic peaks observed. When a difference between the highest temperature of endothermic peak and the softening point is 20° C. or less, the peak temperature is defined as a melting point. When the difference between the highest temperature of endothermic peak and the softening point exceeds 20° C., the peak temperature is ascribed to a glass transition.

The crystalline polyester in the present invention refers to those having an index of crystallinity of from 0.6 to 1.5. The crystalline polyesters has an index of crystallinity of preferably from 0.8 to 1.3, more preferably from 0.9 to 1.1, and even more preferably from 0.98 to 1.05, from the viewpoint of low-temperature fixing ability.

As the raw material monomers for the polyester, a known dihydric or higher polyhydric alcohol component, and a known carboxylic acid component such as dicarboxylic or higher polycarboxylic acids, acid anhydrides thereof and esters thereof can be used.

The alcohol component includes aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; aromatic diols such as an alkylene oxide adduct of bisphenol A represented by the formula (I):

(I)

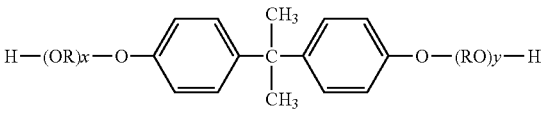

wherein R is an alkyl group having 2 or 3 carbon atoms, x and y are positive numbers, wherein a sum of x and y is from 1 to 16, and preferably from 1.5 to 5.0;

trihydric or higher polyhydric alcohols such as glycerol and pentaerythritol; and the like.

The carboxylic acid component includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acid; aromatic dicarboxylic acids such as phthalic acid, isophthalic acid, and terephthalic acid; tricarboxylic or higher polycarboxylic acids such as trimellitic acid and pyromellitic acid; acid anhydrides thereof, alkyl(1 to 3 carbon atoms) esters thereof; and the like. The above-mentioned acids, acid anhydrides and alkyl esters of the acids are collectively referred to herein as carboxylic acid compound.

Further, the alcohol component and the carboxylic acid component may properly contain a monohydric alcohol and a monocarboxylic acid compound, from the viewpoint of adjusting the molecular weight or the like.

It is preferable that the alcohol component of the crystalline polyester contains an aliphatic diol having 2 to 8 carbon atoms, from the viewpoint of promoting the crystallinity of the polyester. Among them, α,ω-linear alkanediols are more preferable, and 1,4-butanediol, 1,6-hexanediol, and 1,8-octanediol are even more preferable.

The aliphatic diol having 2 to 8 carbon atoms is contained in the entire alcohol component in an amount of preferably from 80 to 100% by mole, and more preferably from 90 to 100% by mole, from the viewpoint of promoting the crystallinity of the polyester. It is desired that 1,4-butanediol, 1,6-hexanediol, 1,8-octanediol or a mixture thereof is contained in the entire alcohol component preferably in an amount of from 80 to 100% by mole, and even more preferably from 90 to 100% by mole.

It is preferable that the carboxylic acid component of the crystalline polyester contains an aliphatic dicarboxylic acid compound having 2 to 6 carbon atoms, such as oxalic acid, malonic acid, maleic acid, fumaric acid, succinic acid, or adipic acid, from the viewpoint of promoting the crystallinity of the polyester. The proportion of the aliphatic dicarboxylic acid compound having 2 to 6 carbon atoms in the entire carboxylic acid component is preferably from 80 to 100% by mole, and more preferably from 90 to 100% by mole, from the viewpoint of promoting the crystallinity of the polyester. Even more preferably, fumaric acid and/or succinic acid is contained in an amount of from 80 to 100% by mole, and even more preferably from 90 to 100% by mole.

Also, it is preferable that the carboxylic acid component of the crystalline polyester contains an aromatic dicarboxylic acid compound having an aromatic ring, such as terephthalic acid, isophthalic acid, phthalic acid and naphthalenedicarboxylic acid; or an alicyclic dicarboxylic acid compound, such as cyclohexanedicarboxylic acid, from the viewpoint of chargeability and durability of the toner. These aromatic dicarboxylic acid compound and aliphatic dicarboxylic acid compound are contained in the entire carboxylic acid component in an amount of preferably from 80 to 100% by mole, and more preferably from 90 to 100% by mole, from the viewpoint of chargeability and durability of the toner. Even more, terephthalic acid is contained in the entire carboxylic acid component preferably in an amount of from 80 to 100% by mole, and more preferably from 90 to 100% by mole.

In other words, in order to promote the crystallinity of the polyester, it is preferable that the crystalline polyester is obtained by polycondensing an alcohol component containing an aliphatic diol having 2 to 8 carbon atoms in an amount of from 80 to 100% by mole, with a carboxylic acid component, which is a carboxylic acid compound, and even more preferably polycondensing an alcohol component containing an aliphatic diol having 2 to 8 carbon atoms in an amount of from 90 to 100% by mole, with a carboxylic acid component, which is a carboxylic acid compound.

Further, in order to promote the crystallinity of the polyester, it is preferable that the crystalline polyester is obtained by polycondensing an alcohol component containing an aliphatic diol having 2 to 8 carbon atoms in an amount of from 80 to 100% by mole, with a carboxylic acid component containing an aliphatic dicarboxylic acid compound having 2 to 6 carbon atoms in an amount of from 80 to 100% by mole, and even more preferably polycondensing an alcohol component containing an aliphatic diol having 2 to 8 carbon atoms in an amount of from 90 to 100% by mole, with a carboxylic acid component containing an aliphatic dicarboxylic acid compound having 2 to 6 carbon atoms in an amount of from 90 to 100% by mole.

On the other hand, from the viewpoint of chargeability and durability of the toner, it is preferable that the crystalline polyester is obtained by polycondensing an alcohol component containing an aliphatic diol having 2 to 8 carbon atoms in an amount of from 80 to 100% by mole, with a carboxylic acid component containing an aromatic dicarboxylic acid compound and/or an alicyclic dicarboxylic acid compound in an amount of from 80 to 100% by mole, and even more preferably polycondensing an alcohol component containing an aliphatic diol having 2 to 8 carbon atoms in an amount of from 90 to 100% by mole, with a carboxylic acid component containing an aromatic dicarboxylic acid compound and/or an alicyclic dicarboxylic acid compound in an amount of from 90 to 100% by mole.

It is preferable that the crystalline polyester in the present invention have acidic groups at the terminal of the molecule. The acidic group includes a carboxyl group, a sulfonate group, a phosphonate group, a sulfinate group and the like. The carboxyl group is preferable from the viewpoint of satisfying both emulsifiability of the resin and environmental durability of the toner prepared therefrom. The amount of the acidic groups at the terminal of the molecule of the crystalline polyester is one of the important factors for determining the stability of the emulsion particles and the particle size distribution and particle size of the toner. In order to stabilize the emulsion particles and obtain a toner having a small particle size with a sharp particle size distribution, the amount of the acidic groups at the terminal of the molecule is preferably from 0.015 to 0.9 mmol, more preferably from 0.08 to 0.85 mmol, even more preferably from 0.15 to 0.8 mmol, and even more preferably from 0.25 to 0.75 mmol, per 1 g of the crystalline polyester.

In addition, a carboxyl group can be introduced into the main chain of the polyester molecule by using a polycarboxylic acid such as trimellitic acid as a carboxylic acid component or a polyhydric alcohol such as pentaerythritol as an alcohol component as occasion demands. The amount of the acidic groups in the main chain of the polyester molecule is preferably 5% by mole or less, more preferably 3% by mole or less, and even more preferably 1% by mole or less, based on the number of moles of the entire carboxylic acid component constituting the polyester, from the viewpoint of inhibition of crystallization.

In addition, the molar ratio as expressed by acidic groups in the main chain of the molecule to acidic groups at the terminal of the molecule in the crystalline polyester is preferably 30% by mole or less, more preferably 20% by mole or less, even more preferably 10% by mole or less, even more preferably 5% by mole or less, and even more preferably 2% by mole or less, from the same viewpoint.

The amount of the acidic groups in the main chain of the crystalline polyester molecule and at the terminal of the molecule thereof can be calculated from the structures and the charging ratio of the raw material acid and the raw material alcohol for the crystalline polyester, the number-average molecular weight of the crystalline polyester, and the determination of the acid value. Also, the amount can be obtained by using an analytic means such as nuclear magnetic resonance spectroscopy (NMR) or X-ray photoelectron spectroscopy (XPS, ESCA, or the like) in combination with the determination of the acid value.

The crystalline polyester is contained in the resin binder in an amount of preferably 60% by weight or more, more preferably 70% by weight or more, and even more preferably 80% by weight or more, from the viewpoint of low-temperature fixing ability. In addition, the crystalline polyester is contained in the toner in an amount of preferably 60% by weight or more, more preferably 70% by weight or more, and even more preferably from 80 to 95% by weight.

On the other hand, it is preferable that the alcohol component of the amorphous polyester contains an alkylene oxide adduct of bisphenol A represented by the formula (I), such as an alkylene (2 to 3 carbon atoms) oxide (average number of moles: 1 to 16) adduct of bisphenol A, such as polyoxypropylene(2.2)-2,2-bis(4-hydroxyphenyl)propane and polyoxyethylene(2.0)-2,2-bis(4-hydroxyphenyl)propane.

The alkylene oxide adduct of bisphenol A represented by the formula (I) is contained in the alcohol component in an amount of preferably 5% by mole or more, more preferably 50% by mole or more, even more preferably 80% by mole or more, and even more preferably 100% by mole.

The polyester can be prepared by, for example, polycondensation of the alcohol component and the carboxylic acid component at a temperature of from 180° C. to 250° C. in an inert gas atmosphere, in the presence of an esterification catalyst as desired.

The amorphous polyester has a softening point of preferably from 95° C. to 160° C., a glass transition temperature of preferably from 50° C. to 75° C., an acid value of preferably from 1 to 40 mg KOH/g, and a hydroxyl value of preferably from 3 to 60 mg KOH/g. The crystalline polyester has a melting point of preferably from 60° C. to 150° C., more preferably from 60° C. to 130° C., and even more preferably from 60° C. to 120° C., from the viewpoint of low-temperature fixing ability.

The amorphous polyester has a number-average molecular weight of preferably from 1000 to 100000, more preferably from 1000 to 50000, and even more preferably from 1000 to 12000, from the viewpoint of durability and fixing ability.

The crystalline polyester has a number-average molecular weight of preferably from 2000 to 100000, more preferably from 2000 to 20000, even more preferably from 2000 to 10000, and even more preferably from 2000 to 8000, from the viewpoint of emulsifiability, fixing ability and offset resistance.

The colorant is not particularly limited, and includes known colorants, which can be properly selected according to its purposes. Specifically, the colorant includes various pigments such as carbon blacks, inorganic composite oxides, Chrome Yellow, HANSA Yellow, Benzidine Yellow, Threne Yellow, Quinoline Yellow, Permanent Orange GTR, PYRAZOLONE Orange, Vulcan Orange, Watchung Red, Permanent Red, Brilliant Carmine 3B, Brilliant Carmine 6B, DuPont Oil Red, PYRAZOLONE Red, LITHOL Red, Rhodamine B Lake, Lake Red C, red iron oxide, Aniline Blue, ultramarine blue, Calco Oil Blue, Methylene Blue Chloride, Phthalocyanine Blue, Phthalocyanine Green, and Malachite Green Oxalate; and various dyes such as Acridine dyes, Xanthene dyes, azo dyes, benzoquinone dyes, Azine dyes, anthraquinone dyes, indigo dyes, thioindigo dyes, Phthalocyanine dyes, Aniline Black dyes, polymethine dyes, triphenylmethane dyes, diphenylmethane dyes, thiazine dyes, thiazole dyes, and xanthene dyes, and these pigments and dyes can be used alone or in admixture of two or more kinds.

The colorant has an average particle size of preferably 5 nm or more, more preferably 10 nm or more, and even more preferably 20 nm or more, from the viewpoint of coloring power and color reproduction regions. On the other hand, since the colorant is included in a primary particle constituted by a resin binder and a colorant, it is preferable that the average particle size of the colorant is smaller than that of the primary particle. The colorant has, therefore, an average particle size of preferably 100 nm or less, more preferably 80 nm or less, and even more preferably 65 nm or less. From these viewpoints, the colorant has an average particle size of preferably from 5 to 100 nm, more preferably from 10 to 80 nm, and even more preferably from 20 to 65 nm. The average particle size of the colorant can be obtained, for example, from a photographic image of an aqueous dispersion during the preparation of the colorant, which is taken with a transmission electron microscope (TEM). The average particle size of the colorant refers to a number-average particle size calculated from at least 200 or more colorant particles.

The amount of the colorant formulated is preferably from 3 to 25 parts by weight, and more preferably from 3 to 10 parts by weight, based on 100 parts by weight of the resin binder.

Further, an additive such as a releasing agent, a charge control agent, an electric conductivity modifier, an extender, a reinforcing filler such as a fibrous substance, an antioxidant, or an anti-aging agent may be appropriately added to the toner obtained according to the present invention.

The releasing agent includes low-molecular weight polyolefins such as polyethylene, polypropylene and polybutene; silicones; fatty acid amides such as oleic amide, erucic amide, recinoleic acid amide, and stearic acid amide; plant-derived waxes such as carnauba wax, rice wax, candelilla wax, haze wax, and jojoba oil; animal-derived waxes such as beeswax; mineral and petroleum waxes such as montan wax, ozokerite, sericite, paraffin wax, microcrystalline wax, and Fischer-Tropsch wax; and the like. These releasing agents can be used alone or in admixture of two or more kinds.

The charge control agent includes a chromium-based azo dye, an iron-based azo dye, an aluminum-based azo dye, a metal complex of salicylic acid, and the like.

The feature of the process for preparing a toner of the present invention resides in that the process includes the step of forming primary particles containing the resin binder and the colorant in an aqueous medium in the presence of a nonionic surfactant, i.e. step (1).

In the process for preparing the toner of the present invention, the method for mixing a resin binder and a colorant or a masterbatch of the colorant is not particularly limited, and a nonionic surfactant may be also mixed at the same time. Also, it is preferable that the step of melt-kneading at least a resin binder and a colorant or a masterbatch of the colorant is carried out, and thereafter, the primary particles containing the resin binder and the colorant are prepared in an aqueous medium. It is preferable that an open-roller type twin-screw kneader is used for the melt-kneading. The open-roller type twin-screw kneader is a kneader containing two rollers arranged in parallel closely to each other, wherein a heating function or a cooling function can be provided by passing a medium for heating or cooling through each roller. Since the open-roller type twin-screw kneader conducts melt-kneading in an open space and also is equipped with a heat roller and a cooling roller, the open-roller type twin-screw kneader can easily dissipate the kneading heat generated during the melt-kneading, which is different from twin-screw extruders conventionally used.

Further, a toner having excellent dispersibility of the colorant can be more easily prepared by controlling the temperature of the kneaded product to a range preferably from equal to or higher than a temperature calculated from Ts minus (−) 20° C. to equal to or lower than a temperature calculated from Ts plus (+) 20° C., and more preferably from equal to or higher than a temperature calculated from Ts−15° C. to equal to or lower than a temperature calculated from Ts+15° C. Here, Ts refers to a softening point of the resin binder. When the resin binder contains two or more kinds of resins, a softening point of the mixed resin is used as Ts. Also, the temperature of the kneaded product refers to a temperature of the kneaded product itself which is deposited to the roller.

The gap between the two rollers is preferably from 0.1 to 10 mm, and more preferably from 0.1 to 3 mm. In addition, structures, sizes, materials and the like of the roller are not particularly limited. Also, the roller surface may be any of smooth, wavy, rugged or other surfaces.

The number of rotation of the roller, i.e. a peripheral speed of the roller, is preferably from 2 to 100 m/min. In addition, the ratio of the rotational speed of the two rollers (cooling roller/heat roller) is preferably from 1/10 to 9/10.

In the present invention, the fine particles of a resin binder can be formed by mixing a resin binder and a nonionic surfactant, thereby lowering the viscosity of the mixture. The present inventors have found that the viscosity of the mixture is lowered due to the fact that the nonionic surfactant is compatible with the resin binder so that a softening point of the resin is surprisingly seemingly lowered. By utilizing this phenomenon, if the softening point of the resin binder compatible with the nonionic surfactant can be seemingly lowered to a temperature equal to or lower than the boiling point of water, even in a resin binder having a melting point or a softening point of 100° C. or higher in the case of the resin alone, a dispersion in which the resin binder is dispersed in water can be obtained by adding water dropwise thereto under normal pressure. Since the dispersion can be prepared by using at least water and a nonionic surfactant, there are some advantages that a resin insoluble to an organic solvent is also applicable, that collection of an organic solvent or the equipment loads for maintaining operable environments used in JP2004-198598 A and JP2002-296839 A would not be necessitated, and that in the present invention utilizing a chemical action by a nonionic surfactant, a specialized equipment as disclosed in JP-A-Hei-9-311502 which utilizes a mechanical means would not be necessitated, so that a resin dispersion can be prepared economically advantageously. Therefore, the aqueous medium used in the present invention may contain a solvent such as an organic solvent, and the aqueous medium contains water in an amount of preferably 95% by weight or more, and more preferably 99% by weight or more. In the present invention, fine particles of a resin binder can be formed even when water alone is used without substantially using an organic solvent.

The nonionic surfactant includes, for example, polyoxyethylene alkylaryl ethers or polyoxyethylene alkyl ethers such as polyoxyethylene nonylphenyl ether, polyoxyethylene oleyl ether, and polyoxyethylene lauryl ether; polyoxyethylene sorbitan esters such as polyoxyethylene sorbitan monolaurate and polyoxyethylene sorbitan monostearate; polyoxyethylene fatty acid esters such as polyethylene glycol monolaurate, polyethylene glycol monostearate, and polyethylene glycol monooleate; and oxyethylene/oxypropylene block copolymers, and the like. In addition, the nonionic surfactant may be used together with an anionic surfactant or a cationic surfactant, within the range which would not impair the effects of the present invention.

In the selection of a nonionic surfactant, it is important that one having an excellent compatibility with resins is selected. In order to obtain a stable dispersion of a resin binder, it is preferable that the nonionic surfactant has an HLB (hydrophile-lipophile balance) value of from 12 to 18, and it is more preferable that two or more kinds of nonionic surfactants having different HLB values are used depending upon the kind of resin binder. For example, in the case of a resin having a high hydrophilicity, at least one kind of nonionic surfactant having an HLB value of from 12 to 18 may be used. In the case of a resin having a high hydrophobicity, it is preferable that two kinds of nonionic surfactants having different HLB values, namely a nonionic surfactant having a low HLB value, for example, an HLB value of from 7 to 10 or so, and a nonionic surfactant having a high HLB value, for example, an HLB value of from 14 to 20, are used together so as to give a weighed average of each HLB value to from 12 to 18. In this case, it is assumed that mainly the nonionic surfactant having an HLB value of from 7 to 10 or so is allowed to be compatible with resins, and the nonionic surfactant having a higher HLB value stabilizes the dispersion of the resins in water.

In addition, it is preferable that the nonionic surfactant is absorbed to the colorant to disperse in the resin binder. It is preferable to adjust the HLB value of the nonionic surfactant to the above-mentioned range, because the nonionic surfactant is more likely to be easily adsorbed to the surface of the colorant, and at the same time, the colorant is more stably present in the resin binder than a colorant which is present in a colloidal dispersion in an aqueous medium.

When the fine particles of the resin binder are formed in water under normal pressure, the nonionic surfactant has a cloud point of preferably from 70° C. to 105° C., and more preferably from 80° C. to 105° C.

The amount of the nonionic surfactant is preferably 5 parts by weight or more, based on 100 parts by weight of the resin binder, from the viewpoint of lowering the melting point of the resin binder, and preferably 80 parts by weight or less, from the viewpoint of controlling the nonionic surfactant remaining in the toner. Therefore, from the viewpoint of satisfying both aspects as described above, the amount of the nonionic surfactant is preferably from 5 to 80 parts by weight, more preferably from 10 to 70 parts by weight, and even more preferably from 20 to 60 parts by weight, based on 100 parts by weight of the resin binder.

Further, in the present invention, the dispersibility of the colorant can be further improved by using a masterbatch of the colorant dispersed in the resin.

The resin usable in the masterbatch of the colorant may be the same kind as or a different kind from the resin binder. From the viewpoint of dispersibility of the colorant, the same kind of resin is preferable.

In addition, the resin binder to be mixed with the masterbatch has an acid value of preferably equal to or higher than the acid value of the resin used in the masterbatch of the colorant, more preferably 2 mg KOH/g or more, and even more preferably 5 mg KOH/g or more, from the viewpoint of dispersibility of the colorant in the resin binder.

The process for preparing a masterbatch of a colorant includes, for example, (1) a process including the steps of charging a mixer or a kneader with dried, powdery colorant and resin, and optionally a dispersion aid such as water, mixing the ingredients to wet the colorant and the resin, heating under pressure or under normal pressure and melt-kneading the colorant and the resin, and thereafter removing moisture therefrom under normal pressure or under a reduced pressure to dry a melt-kneaded product;

(2) a process including the steps of heating dried colorant and resin to melt the resin, adding water to a molten resin mixture, melt-kneading the colorant and the resin under pressure or under normal pressure, and removing moisture therefrom under normal pressure or under a reduced pressure to dry the melt-kneaded product;

(3) a process including the steps of melt-kneading a pressed cake (including a water-based paste) of a colorant and a resin to allow the colorant to migrate from the aqueous phase to a resin phase, and removing moisture therefrom; and the like. Among them, the process (3) is preferable, from the viewpoint of dispersibility of the colorant. The masterbatch obtained according to the process (3) is generally referred to as "flushed masterbatch." In the preparation of the flushed masterbatch, the pressed cake and the resin are kneaded, whereby the colorant migrates from the aqueous phase to the resin phase. The resin is softened into a form of a sticky paste by a strong shearing action with a kneader during the flushing, and the colorant migrates into the resin to be dispersed by an internal shearing force of this softened resin in a sticky paste form. Accordingly, the flushed masterbatch has remarkably excellent dispersibility of the colorant, as compared to the process using a colorant once dried as in the processes (1) and (2).

The colorant obtained by the synthesis is generally in the form of a crystal on the order of micrometers, which is referred to as a "colorant crude." The pressed cake of the colorant usable in the preparation of the flushed masterbatch may be a pressed case of a colorant crude. It is preferable that the pressed cake of the colorant is a pressed cake of a fine colorant obtained by finely pulverizing the colorant crude by a physical means or with a chemical treatment.

The pressed cake of the colorant refers to one obtained by properly dehydrating an aqueous dispersion of the colorant by filtration or the like. The solid content (colorant) in the pressed cake of the colorant is preferably from 30 to 70% by weight. The solid content is more preferably from 40 to 60% by weight, in which the pressed cake is in the form of a water-based paste, from the viewpoint of dispersibility of the colorant in the resin.

One of the physical means for finely pulverizing a colorant crude into fine particles is a mechanical grinding method. The mechanical grinding method is not particularly limited. The mechanical grinding method includes, for example, a method including the steps of supplying crushing media such as milling balls such as metallic balls and ceramic balls into a crusher, and vibrating the crusher, thereby exhibiting a grinding action; a method further including the step of rotating the crusher itself in a drum-like rotation to provide vibration and rotations of the crusher to cause a grinding action; and the like. The grinding effect can be enhanced by using a grinding aid such as sodium chloride or sodium sulfate during grinding. Therefore, the colorant used in the present invention as a raw material of the flushed masterbatch is even more preferably a pressed cake of the colorant ground by a method so-called "salt-milling," in which a salt such as sodium chloride is used as a grinding aid, from the viewpoint of forming a colorant having a smaller particle size. The ground colorant crude is dried usually under a reduced pressure by heating with a heating source (a circulation of a heating medium such as steam; or the like) installed in a dryer, or the like. The ground colorant crude can be dried by a batch process, a continuous process, or the like. The dryer usable in the above process includes a commercially available dryer which is referred to as a vibration fluidized dryer; a vibration mill containing a heating device and a vacuum device; and the like. According to the process of grinding and drying the colorant crude in the dryer, a fine colorant can also be prepared by directly grinding and drying the colorant obtained by the synthesis step and the reaction mixture containing a reaction solvent or the like without being subjected to a pigment preparation step.

The resin used for the flushed masterbatch has a softening point of preferably 130° C. or less, and more preferably 120° C. or less. It is preferable that the temperature at which the pressed cake of the colorant and the resin are kneaded is less than a softening point of the resin and less than the boiling point of water.

In addition, in the preparation of the flushed masterbatch, when the pressed cake of the colorant and the resin are kneaded, an organic solvent can further be used as occasion demands. It is, however, preferable that an organic solvent is not substantially used in the flushed masterbatch usable in the present invention.

In the step (1), when primary particles containing the resin binder and the colorant are formed in an aqueous medium in the presence of a nonionic surfactant, it is desired to keep the temperature in the system within the temperature range of 10° C. below to 10° C. above, preferably 8° C. below to 8° C. above, and more preferably 5° C. below to 5° C. above, the cloud point of the nonionic surfactant, from the viewpoint of dispersibility of the nonionic surfactant and prevention of lowering dispersion efficiency.

In the step (1), it is preferable that, for example, an aqueous medium, preferably deionized water or distilled water, is added dropwise to a homogeneous mixture of resin binders, colorants or masterbatch of colorants, and nonionic surfactants in the system after stirring. It is preferable that careful precaution is taken so that the resin binder containing the colorant which is made compatible with the nonionic surfactant is not separated from water in this step.

The amount of the aqueous medium mixed is preferably from 100 to 3000 parts by weight, more preferably from 400 to 3000 parts by weight, and even more preferably from 800 to 3000 parts by weight, based on 100 parts by weight of the resin binder, from the viewpoint of obtaining homogeneous aggregate particles in the subsequent steps.

The particle size of the primary particles can be controlled by the amount of the nonionic surfactant, the agitation force, and the rate of adding water. In the step (1), the rate of adding the aqueous medium to the mixture containing at least a resin binder, a colorant or a masterbatch of a colorant, and a nonionic surfactant is preferably from 0.1 to 50 g/min, more preferably from 0.5 to 40 g/min, and even more preferably from 1 to 30 g/min, per 100 g of the mixture, from the viewpoint of homogeneously obtaining primary particles.

When the resin binder has an acidic group such as a carboxyl group or a sulfonate group, water may be added after or while all or a part of the resin binder is neutralized. When the resin binder having an acidic group is used, besides the factor of the nonionic surfactant, the factor of self-emulsifiability of the resin can be a controlling factor for the particle size of the primary particles.

A dispersant can be used as occasion demands for the purposes of lowering the melt viscosity and the melting point of the resin binder, and improving the dispersibility of the formed primary particles. The dispersant includes, for example, water-soluble polymers such as polyvinyl alcohol, methyl cellulose, ethyl cellulose, hydroxyethyl cellulose, carboxymethyl cellulose, sodium polyacrylate, and sodium polymethacrylate; anionic surfactants such as sodium dodecylbenzenesulfonate, sodium octadecyl sulfate, sodium oleate, sodium laurate, and potassium stearate; cationic surfactants such as laurylamine acetate, stearylamine acetate, and lauryl trimethylammonium chloride; amphoteric surfactants such as lauryl dimethylamine oxide; and inorganic salts such as tricalcium phosphate, aluminum hydroxide, calcium sulfate, calcium carbonate, and barium carbonate. The amount of the dispersant formulated is preferably 20 parts by weight or less, more preferably 15 parts by weight or less, and even more preferably 10 parts by weight or less, based on 100 parts by weight of the resin binder, from the viewpoint of emulsion stability and detergency.

The solid content of the system for preparing the dispersion of the primary particles is preferably from 7 to 50% by weight, more preferably from 7 to 40% by weight, and even more preferably from 10 to 30% by weight, from the viewpoint of stability of the dispersion and handling property of the dispersion in the aggregating step. The solid contains non-volatile components such as a resin and a nonionic surfactant.

It is preferable that the volume-median particle size ($D_{50}$) of the primary particles is larger than the average particle size of the colorant, from the viewpoint of homogeneous aggregation in the subsequent steps. Specifically, the primary particles have a volume-median particle size ($D_{50}$) of preferably from 0.05 to 3 μm, more preferably from 0.05 to 1 μm, and even more preferably from 0.05 to 0.8 μm. The average particle size of the primary particles refers to a volume-median particle size ($D_{50}$) and can be determined with a laser diffraction particle size analyzer or the like.

Subsequently, the primary particles obtained in the step (1) are subjected to the step of aggregating the primary particles and unifying the aggregated particles, i.e., the step (2).

In the step (2), the solid content of the system in the step of aggregating primary particles (this part of the step (2) is hereinafter referred to as "aggregating step") can be adjusted by adding water to the dispersion of the resin binder as occasion demands. The solid content is preferably from 5 to 50% by weight, more preferably from 5 to 30% by weight, and even more preferably from 5 to 20% by weight, in order that homogeneous aggregation takes place.

In addition, the pH of the system in the aggregating step is preferably from 2 to 10, more preferably from 2 to 8, and even more preferably from 3 to 7, from the viewpoint of satisfying both dispersion stability of the liquid mixture and aggregation property of the fine particles of the resin binder, the colorant and the like.

The temperature of the system in the aggregating step is preferably equal to or higher than a temperature calculated from the softening point of the resin binder −(minus) 50° C. and equal to or lower than a temperature calculated from the softening point −(minus) 10° C., more preferably equal to or higher than a temperature calculated from the softening point of the resin binder −30° C. and equal to or lower than a temperature calculated from the softening point −10° C., from the same viewpoint.

When the primary particles are aggregated, not only the primary particles obtained according to the step (1) alone are aggregated (homo-aggregation), but also the dispersion of the primary particles is mixed separately with the dispersion of the fine resin particle or the like obtained in the same manner as in the step (1) except that the colorant or the masterbatch of a colorant is not used, to aggregate the primary particles with the other fine resin particles (hetero-aggregation).

In the aggregating step, an aggregating agent can be added in order to effectively carry out the aggregation. As the organic aggregating agent, a cationic surfactant in the form of a quaternary salt, polyethyleneimine, or the like may be used, and as the inorganic aggregating agent, an inorganic metal salt, a divalent or higher polyvalent metal complex or the like may be used. The inorganic metal salt includes, for example, metal salts such as sodium sulfate, sodium chloride, calcium chloride, calcium nitrate, barium chloride, magnesium chloride, zinc chloride, aluminum chloride, and aluminum sulfate; and inorganic metal salt polymers such as poly(aluminum chloride), poly(aluminum hydroxide), and poly(calcium sulfide). Among them, a trivalent aluminum salt and its polymers are preferable because these aggregating agents have the high aggregation ability with a small amount and can be conveniently prepared. In addition, the metal complex and the cationic surfactant in the form of a quaternary salt are more preferable from the viewpoint of controlling the charging properties.

The amount of the aggregating agent is preferably 30 parts by weight or less, more preferably 20 parts by weight or less, and even more preferably 10 parts by weight or less, based on 100 parts by weight of the resin binder, from the viewpoint of the environmental resistance of the toner.

It is preferable that the aggregating agent is added in the form of an aqueous medium, and that the mixture is sufficiently stirred during the addition of the aggregating agent and after the termination of the addition.

Subsequently, the aggregate particles, containing at least the resin binder and the colorant, which are obtained in the above-mentioned aggregating step are heated to unify (this part of the step (2) is hereinafter referred to as "unifying step").

The temperature of the system in the unifying step is preferably equal to or higher than a temperature calculated from the softening point of the resin binder −(minus) 30° C. and equal to or lower than a temperature calculated from the softening point of the resin binder +(plus) 10° C., more preferably equal to or higher than a temperature calculated from the softening point of the resin binder −25° C. and equal to or lower than a temperature calculated from the softening point +10° C., and even more preferably equal to or higher than a temperature calculated from the softening point of the resin binder −20° C. and equal to or lower than a temperature calculated from the softening point of the resin binder +10° C., from the viewpoint of controlling particle sizes, particle size distribution, and shapes of the desired toner, and fusibility of the particles. In addition, it is preferable that the agitation rate is a rate at which the aggregate particles are not precipitated.

The unified toner obtained according to the step (2) is properly subjected through the steps such as liquid-solid separation step such as filtration, washing step, and drying step, whereby a toner can be obtained.

In the washing step, it is preferable that an acid is used for removing metal ions on the toner surface, in order to secure satisfactory chargeability and reliability as a toner. Also, it is preferable that the added nonionic surfactant is completely removed by washing, and the washing is carried out with an aqueous medium at a temperature equal to or lower than the cloud point of the nonionic surfactant. The washing is carried out preferably plural times.

In addition, in the drying step, any methods such as vibration-type fluidizing drying method, spray-drying method, freeze-drying method, or flash jet method can be employed. It is preferable that the water content of the toner after drying is adjusted to preferably 1.5% by weight or less, and more preferably 1.0% by weight or less, from the viewpoint of chargeability of the toner.

According to the present invention, a spherical toner having a small particle size and a sharp particle size distribution suitable for high precision and high image quality can be obtained.

The toner has a volume-median particle size ($D_{50}$) is preferably from 1 to 7 μm, more preferably from 2 to 7 μm, and even more preferably from 3 to 6 μm, from the viewpoint of high image quality and productivity.

In addition, the toner has a softening point of preferably from 60° C. to 140° C., more preferably from 60° C. to 130° C., and even more preferably from 60° C. to 120° C., from the viewpoint of low-temperature fixing ability. In addition, the toner has a highest temperature of endothermic peak determined by a differential scanning calorimeter of preferably from 60° C. to 140° C., more preferably from 60° C. to 130° C., and even more preferably from 60° C. to 120° C., from the same viewpoint.

In the toner obtained by the present invention, an aid such as a fluidizing agent can be added as an external additive to the surface of the toner particles. As the external additive, known fine particles, such as fine silica particles of which surface is subjected to a hydrophobic treatment, fine titanium oxide particles, fine alumina particles, fine cerium oxide particles, and carbon black, or fine particles of polymers such as polycarbonate, poly(methyl methacrylate) and silicon resin can be used.

The external additive has a number-average particle size of preferably from 4 to 200 nm, and more preferably from 8 to 30 nm. The number-average particle size of the external additive can be obtained by using a scanning electron microscope or a transmission electron microscope.

The amount of the external additive formulated is preferably from 1 to 5 parts by weight, and more preferably from 1.5 to 3.5 parts by weight, based on 100 parts by weight of the toner before the treatment with the external additive. Here, when a hydrophobic silica is used as an external additive, the desired effects as described above can be obtained by using the hydrophobic silica in an amount of from 1 to 3 parts by weight, based on 100 parts by weight of the toner before the treatment with the external additive.

The toner for electrophotography obtained according to the present invention can be used as a nonmagnetic monocomponent developer, or as a two-component developer obtained by mixing the toner with a carrier.

EXAMPLES

The following examples further describe and demonstrate embodiments of the present invention. The examples are given solely for the purposes of illustration and are not to be construed as limitations of the present invention.

1. Acid Value of Resins

Determined according to JIS K0070.

2. Softening Point, Highest Temperature of Endothermic Peak, Melting Point, and Glass Transition Temperature of Resins and Toners (1) Softening Point The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a die pore size of 1 mm and a length of 1 mm while heating the sample so as to raise the temperature at a rate of 6° C./min and applying a load of 1.96 MPa thereto with the plunger.

(2) Highest Temperature of Endothermic Peak and Melting Point

The highest temperature of endothermic peak is determined using a differential scanning calorimeter ("DSC 210," commercially available from Seiko Instruments, Inc.), by raising its temperature to 200° C., cooling the hot sample from this temperature to 0° C. at a cooling rate of 10° C./min, and thereafter heating the sample so as to raise the temperature at a rate of 10° C./min. Among the endothermic peaks observed, the temperature of an endothermic peak on the highest temperature side is defined as a highest temperature of endothermic peak. When a difference between the highest temperature of endothermic peak and the softening point is within 20° C., the highest temperature of endothermic peak is defined as a melting point. When the highest temperature of endothermic peak is equal to or lower than the temperature calculated from the softening point minus 20° C., the peak is ascribed to glass transition.

(3) Glass Transition Temperature

The glass transition temperature is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a rate of 10° C./min. When a peak is observed at a temperature equal to or lower than the temperature calculated from the softening point minus 20° C., the peak temperature thereof is read off as a glass transition temperature, and when a shift of the curve is observed without any observations of peaks at a temperature equal to or lower than the temperature calculated from the softening point minus 20° C., the temperature of an intersection of the tangential line having the maximum inclination of the curve in the portion of the curve shift and the extended baseline of the high-temperature side of the curve shift is read off as a glass transition temperature. The glass transition temperature is a property inherently owned by the amorphous portion in the resin, which may be generally observed in an amorphous polyester, or may be also observed in an amorphous portion of a crystalline polyester in some cases.

3. Index of Crystallinity for Resins

The index of crystallinity is calculated as a degree of the crystallinity from the softening point and the highest temperature of endothermic peak determined in accordance with the methods mentioned above using the following formula:

$$\text{Index of Crystallinity} = \frac{\text{Softening Point}}{\text{Highest Temperature of Endothermic Peak}}$$

4. Number-Average Molecular Weight of Resins

The number-average molecular weight is obtained from the molecular weight distribution determined by the gel permeation chromatography according to the following method.

(1) Preparation of Sample Solution

A crystalline polyester is dissolved in chloroform and an amorphous polyester is dissolved in tetrahydrofuran, so as to each have a concentration of 0.5 g/100 ml. Each of the resulting solution is then filtered with a fluororesin filter ("FP-200," commercially available from Sumitomo Electric Industries, Ltd.) having a pore size of 2 μm to remove insoluble components, to give a sample solution.

(2) Determination of Molecular Weight Distribution

As an eluant, chloroform when determining for a crystalline polyester, or tetrahydrofuran for an amorphous polyester is allowed to flow at a rate of 1 ml/min, and the column is stabilized in a thermostat at 40° C. One-hundred microliters of the sample solution is injected to the column to determine the molecular weight distribution. The molecular weight of the sample is calculated on the basis of a calibration curve previously prepared. The calibration curve of the molecular weight is one prepared by using several kinds of monodisperse polystyrenes as standard samples.

Analyzer: CO-8010 (commercially available from Tosoh Corporation)

Column: GMHLX+G3000HXL (commercially available from Tosoh Corporation)

5. Particle Size of Dispersed Particles of Primary Particles (1) Measuring Apparatus: Laser diffraction particle size analyzer ("LA-920," commercially available from HORIBA, Ltd.)

(2) Measurement Conditions: A cell for determination is charged with distilled water and a volume-median particle size ($D_{50}$) is obtained at a concentration of the dispersion so that its absorbance is within a proper range.

6. Particle Size of Toners (1) Preparation of Dispersion: 10 mg of a sample to be measured is added to 5 ml of a dispersion medium (a 5% by weight aqueous solution of "EMULGEN 109P" (commercially available from Kao Corporation, polyoxyethylene lauryl ether, HLB value: 13.6)), and dispersed with an ultrasonic disperser for one minute. Thereafter, 25 ml of electrolytic solution ("Isotone II" (commercially available from Beckman Coulter)) is added thereto, and the mixture is further dispersed with the ultrasonic disperser for one minute, to give a dispersion.

(2) Measuring Apparatus: Coulter Multisizer II (commercially available from Beckman Coulter)

Aperture Diameter: 100 μm

Range of Particle Sizes to Be Determined: 2 to 60 μm

Analyzing Software: Coulter Multisizer AccuComp Ver. 1.19 (commercially available from Beckman Coulter)

(3) Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds, to determine its volume-median particle sizes ($D_{50}$).

Preparation Example 1 of Crystalline Polyester

A 5 liter-four-neck flask equipped with a nitrogen inlet tube, a dehydration tube, a stirrer, and a thermocouple was charged with 1652 g of 1,6-hexanediol, 364 g of neopentyl glycol, 2905 g of terephthalic acid, and 10 g of dibutyltin oxide, and the ingredients were reacted at 200° C. until granules of terephthalic acid were not observed. Thereafter, the ingredients were further reacted at 8.3 kPa for 1 hour, to give a resin A. The resin A had a softening point of 115.6° C., a highest temperature of endothermic peak (melting point) of 118.6° C., an index of crystallinity of 0.98, an acid value of 35 mg KOH/g, and a number-average molecular weight of 4450.

Preparation Example 1 of Amorphous Polyester

A four-neck flask equipped with a nitrogen inlet tube, a dehydration tube, a stirrer, and a thermocouple was charged with 16800 g of polyoxypropylene(2.2)-2,2-bis(4-hydroxyphenyl)propane, 5800 g of fumaric acid, and 15 g of dibutyltin oxide, and the ingredients were reacted at 230° C. under a nitrogen atmosphere while stirring, until the softening point determined according to ASTM D36-86 reached 100° C., to give a resin B. The resin B had a softening point of 98° C., a highest temperature of endothermic peak of 63° C., an index of crystallinity of 1.6, a glass transition temperature of 56° C., an acid value of 22.4 mg KOH/g, and a number-average molecular weight of 2930.

Preparation Example 2 of Amorphous Polyester

A four-neck flask equipped with a nitrogen inlet tube, a dehydration tube, a stirrer, and a thermocouple was charged with 34090 g of polyoxypropylene(2.2)-2,2-bis(4-hydroxyphenyl)propane, 5800 g of fumaric acid, and 15 g of dibutyltin oxide, and the ingredients were reacted at 230° C. under a nitrogen atmosphere while stirring, until the softening point determined according to ASTM D36-86 reached 100° C., to give a resin C. The resin C had a softening point of 98° C., a highest temperature of endothermic peak of 63° C., an index of crystallinity of 1.6, a glass transition temperature of 56° C., an acid value of 22.4 mg KOH/g, and a number-average molecular weight of 2930.

Preparation Example 3 of Amorphous Polyester

A four-neck flask equipped with a nitrogen inlet tube, a dehydration tube, a stirrer, and a thermocouple was charged with 12250 g of polyoxypropylene(2.2)-2,2-bis(4-hydroxyphenyl)propane, 21125 g of polyoxyethylene(2.0)-2,2-bis(4-hydroxyphenyl)propane, 15272 g of terephthalic acid, and 15 g of dibutyltin oxide, and the ingredients were reacted at 220° C. under a nitrogen atmosphere while stirring, until the softening point determined according to ASTM D36-86 reached 112° C., to give a resin D. The resin D had a softening point of 110° C., a highest temperature of endothermic peak of 75° C., an index of crystallinity of 1.51, a glass transition temperature of 70° C., an acid value of 5.9 mg KOH/g, and a number-average molecular weight of 4088.

Preparation Example 4 of Amorphous Polyester

A four-neck flask equipped with a nitrogen inlet tube, a dehydration tube, a stirrer, and a thermocouple was charged with 16800 g of polyoxypropylene(2.2)-2,2-bis(4-hydroxyphenyl)propane, 15600 g of polyoxyethylene(2.2)-2,2-bis(4-hydroxyphenyl)propane, 11000 g of terephthalic acid, 1544 g of dodecenylsuccinic anhydride and 15 g of dibutyltin oxide, and the ingredients were stirred at 230° C. under a nitrogen atmosphere for 4 hours. Thereafter, 4600 g of trimellitic anhydride was added thereto and the added mixture was reacted until the softening point determined according to ASTM D36-86 reached 125° C., to give a resin E. The resin E had a softening point of 123° C., a highest temperature of endothermic peak of 72° C., an index of crystallinity of 1.70, a glass transition temperature of 63° C., an acid value of 20.0 mg KOH/g, and a number-average molecular weight of 3400.

Example I-1

Two-hundred grams of the resin B, 10 g of a colorant "ECB-301" (commercially available from DAINICHISEIKA COLOR & CHEMICALS MFG. CO., LTD., copper phthalocyanine), and 40 g of a nonionic surfactant (polyoxyethylene lauryl ether (EO=12 moles added), cloud point: 98° C., HLB value: 15.3) were melted at 170° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 90 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture at a rate of 5 g/min while stirring with the paddle-shaped stirrer at a rate of 300 r/min, totaling to an amount of 1631.5 g. During the addition, the temperature of the system was kept at 95° C., to give a dispersion containing primary particles. The primary particles had a volume-median particle size of 0.13 μm and a solid content of 16.9% by weight in the dispersion. When the dispersion was passed through a wire mesh having a size of 200 mesh (sieve opening: 105 μm), no resin components remained on the wire mesh.

A 2 liter-vessel was charged with 400 g of the resulting dispersion containing the primary particles, and an aqueous solution containing a 1 g portion of calcium chloride as an aggregating agent was added to the dispersion. The dispersion was heated so as to raise the temperature from room temperature to 80° C. at a rate of 1° C./min while stirring (formation of aggregate particles). The pH in the aggregating step was 5.9.

The dispersion was further heated from 80° C. at a rate of 1° C./10 min, the heating was stopped at a point where the temperature of the dispersion reached 98° C., and the dispersion was continued stirring until the temperature returned to room temperature. The ingredients were subjected to suction-filtration, washing, and drying, to give fine particles in which aggregate particles were unified, i.e. a toner. The fine colored resin particles had a volume-median particle size ($D_{50}$) of 5.6 μm and a softening point of 90° C.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an image having no problems for practical purposes was obtained.

Example I-2

The same procedures as in Example I-1 were carried out except that 10 g of a carbon black "MOGUL L" (commercially available from Cabot Corporation) was used in place of the colorant "ECB-301," to give a black toner. The pH in the aggregating step was 5.6. The fine colored resin particles, i.e., toner, before the external addition of the hydrophobic silica had a volume-median particle size ($D_{50}$) of 5.8 μm, and a softening point of 91° C.

A developer prepared by adding silicone-coated ferrite carrier (commercially available from Kanto Denka Kogyo Co., Ltd.) having an average particle size of 60 μm to the resulting black toner was loaded to a commercially available copying machine. When printing was carried out, an image having no problems for practical purposes was obtained.

Example I-3

Two-hundred grams of the resin A, 10 g of a colorant "ECB-301" (commercially available from DAINICHISEIKA COLOR & CHEMICALS MFG. CO., LTD., copper phthalocyanine), and 66 g of a nonionic surfactant (polyoxyethylene lauryl ether (EO=9 moles added), cloud point: 83° C., HLB value: 13.6) were melted at 170° C. in a 5 liter-stainless steel pot, while stirring with a paddle-shaped stirrer at a rate of 200 r/min. The ingredients were stabilized at 90° C., which is a temperature 7° C. higher than the cloud point of the nonionic surfactant, and 25.4 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture at a rate of 5 g/min while stirring with the paddle-shaped stirrer at a rate of 300 r/min, totaling to an amount of 1631.5 g. During the addition, the temperature of the system was kept at 95° C., to give a dispersion containing primary particles. The primary particles had a volume-median particle size of 0.26 μm and a solid content of 19.8% by weight in the dispersion. When the dispersion was passed through a wire mesh having a size of 200 mesh (sieve opening: 105 μm), 2% by weight of a residual component remained on the wire mesh.

A 2 liter-vessel was charged with 400 g of the resulting dispersion containing the primary particles, and an aqueous solution containing a 0.92 g portion of calcium chloride as an aggregating agent was added to the dispersion. The dispersion was heated so as to raise the temperature from room temperature to 100° C. at a rate of 1° C./min while stirring (formation of aggregate particles). The pH in the aggregating step was 6.0.

Further, the temperature of the dispersion was kept at 100° C. for 8 hours, and thereafter heating was stopped, and the dispersion was continued stirring until the temperature returned to room temperature. The ingredients were subjected to suction-filtration, washing, and drying, to give fine particles in which aggregate particles were unified, i.e. a toner. The fine colored resin particles had a volume-median particle size ($D_{50}$) of 10.4 μm and a softening point of 110° C.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an image having no problems for practical purposes was obtained.

Example I-4

Materials having a total weight of 3 kg containing 65 parts by weight of the resin D, 35 parts by weight of the resin E, and 5 parts by weight of a carbon black "MOGUL L" (commercially available from Cabot Corporation, particle size of primary particles: 25 nm) were supplied into a 10 liter HENSCHEL MIXER, and pre-mixed for 3 minutes at a rotational speed of an impeller of 2300 r/min. The mixed resin composed of 65 parts by weight of the resin D and 35 parts by weight of the resin E had a softening point of 117° C.

The resulting mixture was fed to an open-roller type twin-screw continuous kneader "Kneadex" (commercially available from MITSUI MINING COMPANY, LIMITED) with a table feeder, and the mixture was kneaded, to give a kneaded product. Here, the open-roller type twin-screw continuous kneader used at this time had a roller having an outer diameter of 0.14 m and an effective length of 0.8 m, and the operating conditions were a rotational speed of a higher rotation side roller (front roller) of 75 r/min, a rotational speed of a lower rotation side roller (back roller) of 50 r/min, and a gap between the rollers of 0.1 mm. The temperatures of the heating medium and the cooling medium inside the rollers were as follows. The higher rotation side roller had a temperature at the raw material feeding side of 150° C., and a temperature at the kneaded mixture discharging side of 130° C., and the lower rotation side roller had a temperature at the raw material feeding side of 35° C., and a temperature at the kneaded mixture discharging side of 30° C. At this point, the temperature of the melt-kneaded product was 107° C. In addition, the feeding rate of the raw material mixture was 5 kg/hour, and the average residence time was about 5 minutes. The resulting kneaded product for a toner was cooled with a cooling belt, and thereafter the cooled product was roughly pulverized with a mill having a screen of 2 mm in diameter.

Two-hundred and ten grams of the resulting roughly pulverized product and 40 g of a nonionic surfactant (polyoxyethylene lauryl ether (EO=12 moles added), cloud point: 98° C., HLB value: 15.3) were melted at 170° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 90 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture at a rate of 5 g/min while stirring with the paddle-shaped stirrer at a rate of 300 r/min, totaling to an amount of 1600 g. During the addition, the temperature of the system was kept at 95° C., to give a dispersion containing primary particles. The primary particles had a volume-median particle size of 0.18 μm and a solid content of 18.4% by weight in the dispersion. When the dispersion was passed through a wire mesh having a size of 200 mesh (sieve opening: 105 μm), no resin components remained on the wire mesh.

A 2 liter-vessel was charged with 400 g of the resulting dispersion containing the primary particles, and an aqueous solution containing a 1.21 g portion of calcium chloride as an aggregating agent was added to the dispersion. The dispersion was heated so as to raise the temperature from room temperature to 80° C. at a rate of 1° C./min while stirring (formation of aggregate particles). The pH in the aggregating step was 6.1.

The dispersion was further heated from 80° C. at a rate of 1° C./10 min, the heating was stopped at a point where the temperature of the dispersion reached 85° C., and the dispersion was continued stirring until the temperature returned to room temperature (formation of unified particles). The ingredients were subjected to suction-filtration, washing, and drying, to give fine particles in which aggregate particles were unified, i.e. a toner. The fine colored resin particles had a volume-median particle size ($D_{50}$) of 5.3 μm, a softening point of 101° C., and a water content of 0.3% by weight.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a black toner.

A developer prepared by adding silicone-coated ferrite carrier (commercially available from Kanto Denka Kogyo Co., Ltd.) having an average particle size of 60 μm to the resulting black toner was loaded to a commercially available copying machine. When printing was carried out, an image having no problems for practical purposes was obtained.

Comparative Example I-1

The same procedures as in Example I-1 were carried out except that 100 g of water was used in place of a nonionic surfactant, and a resin dispersion was tried to be prepared.

However, it was difficult to stir at a point where the temperature of the system was lowered to 110° C. or so because of the addition of the water used in place of the nonionic surfactant and the addition of an aqueous potassium hydroxide (concentration: 5% by weight), so that the resin dispersion could not be prepared.

Comparative Example I-2

A 5 L-stainless steel pot was charged with 200 g of the resin A, 10 g of a colorant "ECB-301" (commercially available from DAINICHISEIKA COLOR & CHEMICALS MFG. CO., LTD., copper phthalocyanine), and 300 g of methyl ethyl ketone. While the ingredients were stirred with a paddle-shaped stirrer at a rate of 200 r/min, the resin was dissolved at 70° C. to disperse the colorant. Ninety grams of an aqueous potassium hydroxide (concentration: 5% by weight) was added dropwise thereto as a neutralizing agent, while stirring with the paddle-shaped stirrer at a rate of 200 r/min. Thereafter, the methyl ethyl ketone was fractionally distilled away, to give a dispersion containing primary particles having two peaks in the particle size distribution. The primary particles had a volume-median particle size of 0.65 μm and a solid content of 17.6% by weight in the dispersion. When the dispersion was passed through a wire mesh having a size of 200 mesh (sieve opening: 105 μm), no resin components remained on the wire mesh.

Having obtained the primary particles, the same procedures as in Example I-1 were carried out, to give a cyan toner. The pH in the aggregating step was 5.9. The fine colored resin particles, i.e., a toner, before the external addition of a hydrophobic silica had a volume-median particle size ($D_{50}$) of 6.3 μm, and a softening point of 109° C. When fine colored resin particles were observed with a microscope, the dispersibility of the colorant was found to be very poor.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, only an image having an uneven toning was obtained.

It can be seen from the above results that in Examples I-1 to I-4, a toner having a small particle size is obtained to give an excellent image. On the other hand, it can be seen that in the case of Comparative Example I-1 where a nonionic surfactant is not used, primary particles cannot be prepared, and that in the case of Comparative Example I-2 where an organic solvent is used, a toner having a uniform particle size is not obtained.

Preparation Example 1 of Colorant

A 30 liter-glass lining reaction vessel was charged with 3000 parts by weight of phthalic anhydride, 4500 parts by weight of urea, 530 parts by weight of cuprous chloride, 10 parts by weight of ammonium molybdate, 8000 parts by weight of Hizol P (commercially available from NIPPON OIL CORPORATION (formally known as Nippon Petrochemicals Co., Ltd.), alkylbenzene). The ingredients were heated to a temperature of from 170° C. to 200° C. while stirring. The heated ingredients were reacted for 4 to 7 hours, to give a slurry of crude copper phthalocyanine (solid content (crude copper phthalocyanine): 26.5% by weight).

The slurry of crude copper phthalocyanine obtained was fed at a given rate with a pump to a vibration fluidized dryer (commercially available from CHUO KAKOHKI CO., LTD., Model VHS30) made of SUS316, packed with steel balls having a diameter of ⅜ inch (9.525 mm) as a grinding aid in an internal volume of up to 70% of the dryer. The vibration fluidized dryer was continuously operated while feeding, thereby drying copper phthalocyanine particles while grinding. The solvent removal was terminated in an about 2-hour operation. The finely ground copper phthalocyanine was heat-treated (at 90° C. to 100° C.) respectively with a 2% by weight aqueous potassium hydroxide and a 2% by weight aqueous sulfuric acid, each in an amount 20 to 30 times that of the finely ground copper phthalocyanine, to remove impurities such as an unreacted product, a by-product, and the like therefrom. The heat-treated product was washed with water and dried, to give a brilliant copper phthalocyanine pigment A having an average particle size of 60 nm.

Preparation Example 2 of Colorant

The same procedures as in Preparation Example 1 were carried out up to the step of removing impurities from the finely ground copper phthalocyanine and washing the treated product with water. Thereafter, excess water was filtered out, to give a water-based pasty pressed cake B (solid content (copper phthalocyanine pigment): 47.9% by weight) of the brilliant copper phthalocyanine pigment having an average particle size of 60 nm.

Preparation Example 3 of Colorant

The same procedures as in Preparation Example 2 were carried out except that sodium chloride was further used as a grinding aid in an amount of 50 parts by weight, per 100 parts by weight of the solid content in the slurry of the crude copper phthalocyanine, to give a water-based pasty pressed cake C (solid content (copper phthalocyanine pigment): 48.5% by weight) of the brilliant copper phthalocyanine pigment having an average particle size of 30 nm.

Preparation Example 1 of Masterbatch of Colorants

A HENSCHEL MIXER was charged with 70 parts by weight of a fine powder of the resin C, 30 parts by weight of the copper phthalocyanine pigment A, and 30 parts by weight of water, and the ingredients were mixed for 5 minutes to wet the mixture of the fine powder and the copper phthalocyanine pigment A. Next, a kneader type mixer was charged with the wet mixture, and the mixture was gradually heated. The resin in the mixture was melted at a temperature of about 90° C. to about 110° C., the mixture was kneaded in the co-presence of water, and the mixture was continued kneading at a temperature of from 90° C. to 110° C. for 20 minutes while evaporating water from the mixture.

Further, the mixture was continued kneading at 120° C. to evaporate the remaining water content, thereby dehydrating the kneaded mixture to dryness. The dried mixture was continued kneading at a temperature of from 120° C. to 130° C. for 10 minutes, and the kneaded mixture was cooled. Thereafter, the cooled mixture was melt-kneaded with a triple-roller type kneader, the melt-kneaded mixture was cooled, and the cooled mixture was roughly pulverized, to give a masterbatch A of a colorant containing a copper phthalocyanine pigment in a concentration of 30% by weight. This masterbatch was placed on a slide glass, and thermally melted. The melted masterbatch was observed with a microscope. As a result, it was found that all the pigment particles were finely dispersed and no coarse particles were found in the masterbatch.

Preparation Example 2 of Masterbatch of Colorant

The same procedures as in Preparation Example 1 were carried out except that the pressed cake B of the copper phthalocyanine pigment was used in place of the copper phthalocyanine pigment A, so that the copper phthalocyanine pigment is contained in an amount of 30 parts by weight, and that water was not used, to give a masterbatch B of a colorant containing a copper phthalocyanine pigment in a concentration of 30% by weight. This masterbatch was placed on a slide glass, and thermally melted. When the melted masterbatch was observed with a microscope, it was found that all the pigment particles were finely dispersed and no coarse particles were found in the masterbatch.

Preparation Example 3 of Masterbatch of Colorant

The same procedures as in Preparation Example 1 were carried out except that the pressed cake C of the copper phthalocyanine pigment was used in place of the copper phthalocyanine pigment A, so that the copper phthalocyanine pigment is contained in an amount of 30 parts by weight, and that water was not used, to give a masterbatch C of a colorant containing a copper phthalocyanine pigment in a concentration of 30% by weight. This masterbatch was placed on a slide glass, and thermally melted. The melted masterbatch was observed with a microscope. As a result, it was found that all the pigment particles were finely dispersed and no coarse particles were found in the masterbatch.

Preparation Example 4 of Masterbatch of Colorant

The same procedures as in Preparation Example 1 were carried out except that 70 parts by weight of a fine powder of the resin D was used in place of the resin C, that the pressed cake B of the copper phthalocyanine pigment was used in place of the copper phthalocyanine pigment A so that the copper phthalocyanine pigment is contained in an amount of 30 parts by weight of the copper phthalocyanine pigment, and that water was not used, to give a masterbatch D of a colorant containing a copper phthalocyanine pigment in a concentration of 30% by weight. This masterbatch was placed on a slide glass, and thermally melted. The melted masterbatch was observed with a microscope. As a result, it was found that all the pigment particles were finely dispersed and no coarse particles were found in the masterbatch.

Example II-1

Four-hundred and forty-two grams of the resin C, 83 g of the masterbatch A of a colorant, and 40 g of a nonionic surfactant (polyoxyethylene lauryl ether (EO=12 moles added), cloud point: 98° C., HLB value: 15.3) were melted at 170° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 226 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture at a rate of 5 g/min while stirring with the paddle-shaped stirrer at a rate of 200 r/min, totaling to an amount of 2000 g. During the addition, the temperature of the system was kept at 95° C., to give a dispersion containing primary particles. The primary particles had an average particle size of 0.153 μm and a solid content of 24.8% by weight in the dispersion. When the dispersion was passed through a wire mesh having a size of 200 mesh (sieve opening: 105 μm), no resin components remained on the wire mesh.

A 1 liter-vessel was charged with 350 g of the resulting dispersion containing the primary particles. Next, an aqueous solution containing a 2.14 g portion of calcium chloride as an aggregating agent was added thereto while stirring with a paddle-shaped stirrer at a rate of 100 r/min, and the dispersion mixture was stirred at room temperature for 10 minutes. Thereafter, the dispersion was heated so as to raise the temperature from room temperature to 81° C. at a rate of 1° C./5 min while stirring (formation of aggregate particles). The pH in the aggregating step was 5.9.

The heating was stopped at a point where the temperature of the dispersion reached 81° C. The dispersion was gradually cooled to room temperature while stirring (formation of unified particles). The ingredients were subjected to suction-filtration, washing, and drying, to give fine colored resin particles. The fine colored resin particles had a volume-median particle size (D50) of 6.1 μm and a water content of 0.3% by weight.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner. The resulting cyan toner had a volume-median particle size ($D_{50}$) of 6.7 μm and a softening point of 88° C. The results are shown in Table 1.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an excellent image was obtained.

Example II-2

The same procedures as in Example II-1 were carried out except that 83 g of the masterbatch B of a colorant was used in place of the masterbatch A of a colorant, to give a dispersion containing primary particles. The primary particles had an average particle size of 0.148 μm and a solid content of 23.9% by weight in the dispersion. When the dispersion was passed through a wire mesh having a size of 200 mesh (sieve opening: 105 μm), no resin components remained on the wire mesh.

A 1 liter-vessel was charged with 350 g of the resulting dispersion containing the primary particles. Next, an aqueous solution containing a 2.14 g portion of calcium chloride as an aggregating agent was added thereto while stirring with a paddle-shaped stirrer at a rate of 100 r/min. The dispersion mixture was stirred at room temperature for 10 minutes. Thereafter, the dispersion was heated so as to raise the temperature from room temperature to 80° C. at a rate of 1° C./min while stirring (formation of aggregate particles). The pH in the aggregating step was 5.8.

The dispersion was heated from 80° C. at a rate of 1° C./10 min. The heating was stopped at a point where the temperature of the dispersion reached 95° C. The dispersion was gradually cooled to room temperature while stirring (formation of unified particles). The ingredients were subjected to suction-filtration, washing, and drying, to give fine colored resin particles. The fine colored resin particles had a volume-median particle size ($D_{50}$) of 5.8 μm and a water content of 0.2% by weight.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner. The resulting cyan toner had a volume-median particle size ($D_{50}$) of 6.0 μm and a softening point of 89° C. The results are shown in Table 1.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an excellent image was obtained.

Example II-3

The same procedures as in Example II-1 were carried out except that 83 g of the masterbatch C of a colorant was used in place of the masterbatch A of a colorant, to give a dispersion containing primary particles. The primary particles had an average particle size of 0.117 μm and a solid content of 25.0% by weight in the dispersion. When the dispersion was passed through a wire mesh having a size of 200 mesh (sieve opening: 105 μm), no resin components remained on the wire mesh.

A 1 liter-vessel was charged with 350 g of the resulting dispersion containing the primary particles. Next, an aqueous solution containing a 2.10 g portion of calcium chloride as an aggregating agent was added thereto while stirring with a paddle-shaped stirrer at a rate of 100 r/min. The dispersion mixture was stirred at room temperature for 10 minutes. Thereafter, the dispersion was heated so as to raise the temperature from room temperature to 80° C. at a rate of 1° C./min while stirring (formation of aggregate particles). The pH in the aggregating step was 6.0.

The dispersion was heated from 80° C. at a rate of 1° C./10 min, the heating was stopped at a point where the temperature of the dispersion reached 96° C., and the dispersion was gradually cooled to room temperature while stirring (formation of unified particles). The ingredients were subjected to suction-filtration, washing, and drying, to give fine colored resin particles. The fine colored resin particles had a volume-median particle size ($D_{50}$) of 5.0 μm and a water content of 0.3% by weight.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner. The resulting cyan toner had a volume-median particle size ($D_{50}$) of 5.2 μm and a softening point of 89° C. The results are shown in Table 1.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an excellent image was obtained.

Example II-4

One-hundred and sixty-five grams of the resin C, 50 g of the masterbatch A of a colorant, and 100 g of a nonionic surfactant (polyoxyethylene lauryl ether (EO=12 moles added), cloud point: 98° C., HLB value: 15.3) were melted at 170° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 64.5 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture at a rate of 5 g/min while stirring with the paddle-shaped stirrer at a rate of 200 r/min, totaling to an amount of 1225 g. During the addition, the temperature of the system was kept at 95° C., to give a dispersion containing primary particles. The primary particles had an average particle size of 0.245 μm and a solid content of 21.8% by weight in the dispersion. When the dispersion was passed through a wire mesh having a size of 200 mesh (sieve opening: 105 μm), 0.05 g of a residual component remained on the wire mesh.

On the other hand, 200 g of the resin C and 20 g of a nonionic surfactant (polyoxyethylene lauryl ether (EO=12 moles added), cloud point: 98° C., HLB value: 15.3) were melted at 170° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 90.4 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture at a rate of 5 g/min while stirring with the paddle-shaped stirrer at a rate of 200 r/min, totaling to an amount of 1043 g. During the addition, the temperature of the system was kept at 95° C., to give a dispersion containing resin particles. The primary particles had an average particle size of 0.148 μm and a solid content of 16.0% by weight in the dispersion. When the dispersion was passed through a wire mesh having a size of 200 mesh (sieve opening: 105 μm), no resin components remained on the wire mesh.

A 1 liter-vessel was charged with 200 g of the resulting dispersion containing the primary particles and 100 g of the dispersion containing the resin particles, and the ingredients were mixed at room temperature. Next, an aqueous solution containing a 1.60 g portion of calcium chloride as an aggregating agent was added to the mixture while stirring with a paddle-shaped stirrer at a rate of 100 r/min. The mixed dispersion was stirred at room temperature for 10 minutes. Thereafter, the dispersion was heated so as to raise the temperature from room temperature to 80° C. at a rate of 1° C./min while stirring (formation of aggregate particles). The pH in the aggregating step was 5.8.

The dispersion was heated from 80° C. at a rate of 1° C./10 min, the heating was stopped at a point where the temperature of the dispersion reached 95° C., and the dispersion was gradually cooled to room temperature while stirring (formation of unified particles). The ingredients were subjected to suction-filtration, washing, and drying, to give fine colored resin particles. The fine colored resin particles had a volume-median particle size ($D_{50}$) of 5.8 μm and a water content of 0.2% by weight.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner. The resulting cyan toner had a volume-median particle size ($D_{50}$) of 6.0 μm and a softening point of 88° C. The results are shown in Table 1.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an excellent image was obtained.

Example II-5

The same procedures as in Example II-1 were carried out except that 83 g of the masterbatch D of a colorant was used in place of the masterbatch A of a colorant and the amount of the aqueous potassium hydroxide solution was changed to 207.8 g, to give a dispersion containing primary particles. The primary particles had an average particle size of 0.152 μm and a solid content of 24.3% by weight in the dispersion. When the dispersion was passed through a wire mesh having a size of 200 mesh (sieve opening: 105 μm), nothing remained on the wire mesh.

A 1 liter-vessel was charged with 350 g of the resulting dispersion containing the primary particles. Next, an aqueous solution containing a 1.60 g portion of calcium chloride as an aggregating agent was added thereto while stirring with a paddle-shaped stirrer at a rate of 100 r/min. The dispersion mixture was stirred at room temperature for 10 minutes. Thereafter, the dispersion was heated so as to raise the temperature from room temperature to 80° C. at a rate of 1°

C./min while stirring (formation of aggregate particles). The pH in the aggregating step was 5.6.

The dispersion was heated at a rate of 1° C./10 min so as to raise the temperature from 80° C., and the heating was stopped at a point where the temperature of the dispersion reached 95° C. The dispersion was gradually cooled to room temperature while stirring (formation of unified particles). The ingredients were subjected to suction-filtration, washing, and drying, to give fine colored resin particles. The fine colored resin particles had a volume-median particle size ($D_{50}$) of 5.2 μm and a water content of 0.2% by weight.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner. The resulting cyan toner had a volume-median particle size ($D_{50}$) of 5.6 μm and a softening point of 104° C. The results are shown in Table 1.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an excellent image was obtained.

Example II-6

The same procedures as in Example I-4 up to melt-kneading were carried out except that 17 parts by weight of the masterbatch B were used in place of the carbon black, to give a roughly pulverized product.

Two-hundred and ten grams of the resulting roughly pulverized product and 40 g of a nonionic surfactant (polyoxyethylene lauryl ether (EO=12 moles added), cloud point: 98° C., HLB value: 15.3) were melted at 170° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 90 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture at a rate of 5 g/min while stirring with the paddle-shaped stirrer at a rate of 300 r/min, totaling to an amount of 1600 g. During the addition, the temperature of the system was kept at 95° C., to give a dispersion containing primary particles. The primary particles had a volume-median particle size of 0.110 μm and a solid content of 20.4% by weight in the dispersion. When the dispersion was passed through a wire mesh having a size of 200 mesh (sieve opening: 105 μm), no resin components remained on the wire mesh.

A 2 liter-vessel was charged with 400 g of the resulting dispersion containing the primary particles, and an aqueous solution containing a 1.21 g portion of calcium chloride as an aggregating agent was added thereto. The dispersion was heated so as to raise the temperature from room temperature to 80° C. at a rate of 1° C./min while stirring (formation of aggregate particles). The pH in the aggregating step was 5.9.

Further, the dispersion was heated from 80° C. at a rate of 1° C./10 min, and the heating was stopped at a point where the temperature of the dispersion reached 85° C., and the dispersion was continued stirring until the temperature returned to room temperature (formation of unified particles). The ingredients were subjected to suction-filtration, washing, and drying, to give fine particles in which aggregate particles were unified, i.e. a toner. The fine colored resin particles had a volume-median particle size ($D_{50}$) of 5.0 μm, a softening point of 101° C., and a water content of 0.2% by weight.

A hydrophobic silica ("TS530," commercially available from Wacker Chemicals, number-average particle size: 8 nm) was externally added in an amount of 1.0 part by weight, based on 100 parts by weight of the fine colored resin particles with a HENSCHEL MIXER, to give a cyan toner.

A developer prepared by adding silicone-coated ferrite carrier (commercially available from Kanto Denka Kogyo Co., Ltd.) having an average particle size of 60 μm to the resulting cyan toner was loaded to a commercially available copying machine. When printing was carried out, an excellent image was obtained.

Comparative Example II-1

Only 442 g of the resin C and 83 g of the masterbatch B of a colorant were melted at 170° C. in a 5 liter-stainless steel pot without using a nonionic surfactant, while stirring with a paddle-shaped stirrer at a rate of 200 r/min. The ingredients were stabilized at 95° C., and 226 g of an aqueous potassium hydroxide (concentration: 5% by weight) was added dropwise thereto as a neutralizing agent, while stirring with the paddle-shaped stirrer at a rate of 200 r/min. Subsequently, deionized water was added dropwise to the mixture while stirring with the paddle-shaped stirrer at a rate of 200 r/min. However, during the course of the dropwise addition, a melt viscosity became high, thereby making it difficult to prepare a dispersion containing primary particles, whereby consequently the preparation of a toner was stopped.

[Evaluation of Dispersibility of Colorant]

A sample toner was embedded in a polyester, and an ultrathin-slice sample was prepared with an ultramicrotome. The sample was photographed with a transmission electron microscope (commercially available from JEOL, Ltd., "JEM-2000FX") under conditions of an acceleration voltage of 80 kV and a magnification of 20000 times. The dispersion state of the colorant in the toner was visually observed on the photograph and evaluated on five ranks of ranks 1 (poor) to 5 (excellent). The results are shown in Table 1.

TABLE 1

| | Resin Binder | Colorant (Average Particle Size) | Nonionic Surfactant | Aggregation Method | Dispersibility of Colorant |
|---|---|---|---|---|---|
| Ex. II-1 | Resin C | Masterbatch A (60 nm) | Present | Homo-Aggregation | 3 |
| Ex. II-2 | Resin C | Masterbatch B (60 nm) | Present | Homo-Aggregation | 4 |
| Ex. II-3 | Resin C | Masterbatch C (30 nm) | Present | Homo-Aggregation | 5 |
| Ex. II-4 | Resin C | Masterbatch C (30 nm) | Present | Hetero-Aggregation | 3 |
| Ex. II-5 | Resin C | Masterbatch D (60 nm) | Present | Homo-Aggregation | 4 |
| Ex. II-6 | Resin D Resin E | Masterbatch B (60 nm) | Present | Homo-Aggregation | 5 |
| Comp. Ex. II-1 | Resin C | Masterbatch B (60 nm) | Absent | Homo-Aggregation | Not able to be prepared |

It can be seen from the above results in Examples II-1 to II-6 that a toner having a small particle size and an excellent dispersibility of a colorant is obtained. On the other hand, it can be seen from the above results in Comparative Example II-1 where a nonionic surfactant is not been used, primary particles cannot be prepared.

The toner for electrophotography obtained by the present invention can be suitably used in, for example, development of a latent image formed in electrophotography, electrostatic recording method, electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing a toner for electrophotography comprising a resin binder and a colorant, comprising the steps of:

(1) forming primary particles comprising the resin binder and the colorant in an aqueous medium in the presence of a nonionic surfactant; and (2) aggregating the primary particles, and unifying the aggregated particles, wherein at least one of the following conditions (a) and (b) apply:

(a) the primary particles are obtained from the resin binder and a masterbatch of the colorant dispersed in a resin, the colorant has an average particle size of from 5 to 100 nm, and the primary particles in the step (1) have an average particle size of from 0.05 to 3 μm, the average particle size of the colorant being smaller than that of the primary particles;

(b) the step (1) comprises the step of adding an aqueous medium to a mixture comprising at least the resin binder, the colorant, and the nonionic surfactant, wherein the aqueous medium is added in an amount of from 0.1 to 50 g/min per 100 g of the mixture.

2. The process according to claim 1, wherein condition (a) applies, and the primary particles are obtained after being subjected to the step of melt-kneading at least the resin binder and the masterbatch of the colorant.

3. The process according to claim 2, wherein the melt-kneading is carried out with an open-roller twin-screw kneader.

4. The process according to claim 1, wherein condition (a) applies, and the masterbatch of the colorant is a flushed masterbatch.

5. The process according to claim 4, wherein the flushed masterbatch is obtained from a pressed cake of the colorant ground by salt-milling as a raw material.

6. The process according to claim 5, wherein the pressed cake has a solid content of from 30 to 70% by weight.

7. The process according to claim 1, wherein the nonionic surfactant is used in an amount of from 5 to 80 parts by weight, based on 100 parts by weight of the resin binder.

8. The process according to claim 1, wherein the resin binder comprises a polyester.

9. The process according to claim 1, wherein condition (a) applies, and the resin binder to be mixed with the masterbatch has an acid value of equal to or higher than that of the resin used in the masterbatch.

10. The process according to claim 1, wherein the toner has a volume-median particle size ($D_{50}$) of from 1 to 7 μm.

11. The process according to claim 1, wherein condition (a) applies.

12. The process according to claim 1, wherein condition (b) applies.

13. The process according to claim 1, wherein the nonionic surfactant has an HLB of from 12 to 18.

14. The process according to claim 1, wherein step (1) is carried out a temperature within ±10° C. of the cloud point of the nonionic surfactant.

15. The process according to claim 1, wherein step (1) is carried out a temperature within ±8° C. of the cloud point of the nonionic surfactant.

16. The process according to claim 1, wherein step (1) is carried out a temperature within ±5° C. of the cloud point of the nonionic surfactant.

* * * * *